United States Patent [19]

Bernard et al.

[11] Patent Number: 4,931,766

[45] Date of Patent: Jun. 5, 1990

[54] OPTICAL SIGNALLING DEVICE OF THE LUMINOUS TUBE TYPE

[75] Inventors: Jacques Bernard, Angouleme; Dominique Charrier, St-Amand de Boixe, both of France

[73] Assignee: La Telemecanique Electrique, Nanterre Cedex, France

[21] Appl. No.: 313,365

[22] Filed: Feb. 21, 1989

[30] Foreign Application Priority Data

Feb. 24, 1988 [FR] France ..... 88 02224

[51] Int. Cl.[5] ..... G08B 5/00

[52] U.S. Cl. ..... 340/332; 340/815.15; 362/263; 315/241 S

[58] Field of Search ..... 340/332, 815.15, 815.16, 340/321, 815.2, 473; 315/241 S; 362/263, 265; 361/399

[56] References Cited

U.S. PATENT DOCUMENTS

| | | | |
|---|---|---|---|
| 2,731,577 | 1/1956 | Floyd | 362/263 X |
| 3,668,611 | 6/1972 | Schwartz | 362/263 X |
| 3,673,462 | 6/1972 | Girard | 315/241 S X |
| 4,142,179 | 2/1979 | Lowndes | 340/321 |
| 4,346,329 | 8/1982 | Schmidt . | |
| 4,429,348 | 1/1984 | Dean | 361/399 |

FOREIGN PATENT DOCUMENTS

| | | |
|---|---|---|
| 1807418 | 3/1960 | Fed. Rep. of Germany . |
| 8004221 | 5/1980 | Fed. Rep. of Germany . |
| 8604696 | 5/1986 | Fed. Rep. of Germany . |
| 8701424 | 5/1987 | Fed. Rep. of Germany . |
| 1462196 | 1/1977 | United Kingdom . |
| 2090956 | 7/1982 | United Kingdom . |

OTHER PUBLICATIONS

*Electronics Australia*, vol. 33, No. 5, Aug. 1971, pp. 56–57, 59, 61, Hughes, 6, "A High Efficiency Flasher".

*Primary Examiner*—Joseph A. Orsino
*Assistant Examiner*—Brian R. Tumm
*Attorney, Agent, or Firm*—Young & Thompson

[57] ABSTRACT

An optical signalling device has a partially transparent envelope (2), a substantially U-shaped luminous tube (10) containing a gaseous atmosphere being placed within the envelope and supplied by a capacitor (C) which is charged and discharged by electric circuits placed on a printed circuit card (17).

Within an insulating casing (4) having an end-wall (13) and side walls (14, 15), there is placed and maintained a printed circuit card (17) which carries conductive tracks (38, 39) soldered directly to the supply terminals (36, 37) of the gas tube (10). The gas tube is placed in a plane substantially parallel to a longitudinal axis of the casing and has two portions (32*a*, 33*a*) adjacent to the ends of its parallel arms (32, 33) which are securely clamped between two resilient lips (44) forming part of the end-wall (13) through which they pass. The bent region (35) of the tube extends externally of the end-wall and is protected by a transparent cover (5) of the envelope (2).

5 Claims, 1 Drawing Sheet

OPTICAL SIGNALLING DEVICE OF THE LUMINOUS TUBE TYPE

BACKGROUND OF THE INVENTION

1. Field of the Invention

The present invention relates to an optical signalling device having a partially transparent envelope, a substantially U-shaped luminous tube containing a gaseous atmosphere being placed within said envelope and supplied by a capacitor which is charged and discharged by means of electric circuits placed on a printed circuit card.

2. Description of the Prior Art

The devices aforesaid are employed for emitting light signals of short duration and high intensity in order to attract the attention of persons at distant locations, and in particular to warn maintenance personnel of the presence or imminence of a danger. These devices usually consist of gas-filled glass tubes which are bent in the shape of a U and have a certain degree of fragility. These tubes have two supply terminals which are on the one hand sealed in the glass and on the other hand electrically connected to a capacitor by means of an electronic circuit arranged on a printed circuit card in which supply voltages of the order of 300 V must be employed in order to charge the capacitor. Moreover, conduction of the luminous tube takes place by excitation of an electrode which is external to the tube and has the function of producing initial ionization of the gas by application of a voltage of several kilovolts.

The application of the components required for generating these voltages as well as the relative fragility of the tube have led a certain number of manufacturers to encapsulate all or part of the circuits concerned in a block of insulating plastic having the ancillary function of providing a mechanical support for the tube.

While producing good results when the materials are suitably chosen, this technique has the disadvantage, however, of being technically costly.

The aim of the present invention is therefore to endow a signalling device having the above-defined structure with improvements which are intended to simplify the manufacturing process while at the same time retaining the desired electrical properties and also providing the gas tube with effective mechanical support without having recourse to coating material.

SUMMARY OF THE INVENTION

In accordance with the invention, said signalling device is distinguished by the fact that, within an insulating casing having an end-wall and surrounding side walls, there is placed and maintained a printed circuit card which carries conductive tracks soldered directly to the supply terminals of the gas tube, said gas tube being placed in a plane substantially parallel to a longitudinal axis of the casing and having two portions adjacent to the ends of its parallel arms which are securely clamped between two resilient lips forming part of the end-wall through which they pass whilst the bent region of said tube extends externally of said end-wall and is protected by a transparent cover of the envelope of the device.

The luminous tube is thus secured to the printed circuit card by means of its terminals which are soldered to conductive tracks of the card.

Moreover, the luminous tube is clamped elastically between two resilient lips forming part of the casing end-wall, with the result that the tube is resiliently supported and protected against impacts.

Furthermore, this mode of resilient attachment of the tube considerably facilitates mounting of the assembly consisting of tube and printed circuit card within the envelope of the device.

DESCRIPTION OF THE PREFERRED EMBODIMENTS

Figure 1:
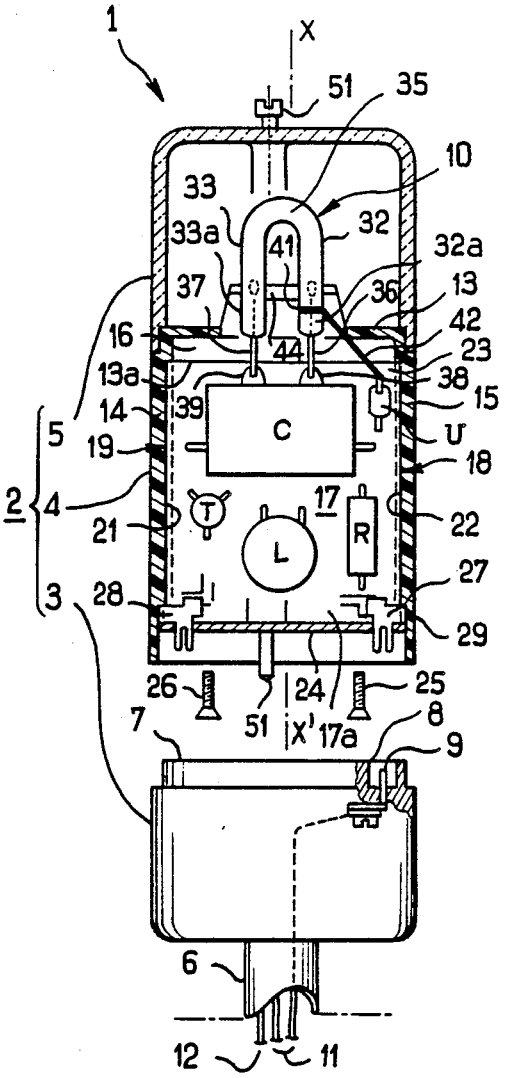
FIG. 1 is a view in elevation of a signalling device as shown partly in cross-section along a plane parallel to the plane P—P' of FIG. 3.
Figure 3:
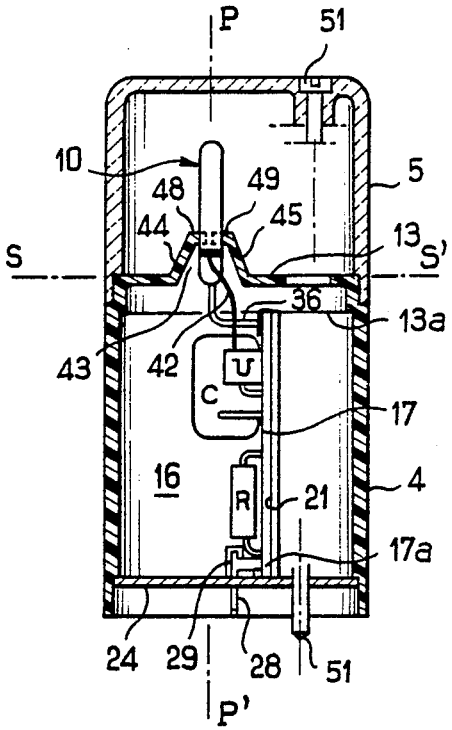
FIG. 3 is a view in cross-section along a plane perpendicular to the plane of FIG. 1.
Figure 2:
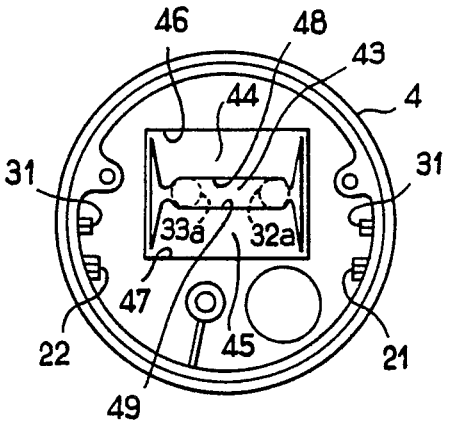
FIG. 2 is a bottom view of the insulating casing of the device, the printed circuit and the luminous tube having been removed for greater clarity.

The optical signalling device 1 shown in FIGS. 1 to 3 has an envelope 2 formed by the assembly of a base 3, an opaque insulating casing 4 and a transparent cover 5.

In an advantageous embodiment, the envelope 2 has a shape of revolution about an axis X—X' and the base 3 is associated with a support 6 of tubular shape in which extend electric supply and control leads 11, 12.

The base 3 is provided on a top face 7 with a certain number of recesses as designated by the reference 8, flat contact-pins such as the pin 9 being located at the bottom of said recesses and connected to the leads 11, 12.

The casing 4 has an end-wall 13 and side walls 14, 15 delimiting an internal volume 16 in which is housed a printed circuit card 17. This card 17 is guided laterally and maintained within the volume 16 for example by penetration of its opposite edges 18, 19 (see FIG. 1) in internal and opposite longitudinal grooves 21, 22 of the side walls 14, 15.

Longitudinal position-maintenance of the card 17 is carried out on the one hand by application of the end 23 of this latter against the end-wall 13 or against an adjacent internal flange **13*a* (see FIG. 3) and on the other hand by means of an insulating closure plate 24 which is rigidly fixed to the casing 4, for example by means of screws 25, 26. The printed circuit card 17 is provided at the end 17*a* adjacent to the closure plate 24 with resilient metal clips such as the clips 27, 28 which pass through said plate and are adapted to cooperate with the contact-pins 9 of the base 3 at the time of association of this latter with the casing 4**.

Advantageously, said resilient clips 27, 28 each carry a thin transverse extension such as the extension 29 which is intended to penetrate into a corresponding slit 31 (see FIG. 2) of an adjacent wall in order to endow them with sufficient rigidity and to prevent the stresses which they sustain at the moment of their engagement on the contact-pins 9 from being transferred to conductive tracks of the printed circuit with which they are associated.

The printed circuit card 17 carries on its surface electrical components such as a capacitor C, a resistor R, an inductor L and components T and U which are intended to constitute a supply and control circuit for a gaseous-atmosphere luminous tube 10 of glass having a bent portion 35 and two parallel arms 32, 33 each provided with an extension in the form of a terminal 36, 37.

As can be seen in FIG. 1, said terminals 36, 37 are directly soldered on conductive tracks 38, 39 terminating at the end of the card 17 in order to support the tube 10 whilst an ignition electrode 41 is connected by means of a conductor 42 either to a particular track of the card or directly to a suitable terminal of a transformer U (as also shown in FIG. 3).

It is clear that the printed circuit card 17 as well as the set of components carried by this card can be mounted and soldered before the card is placed in position within the casing 4.

When the printed circuit card 17 is placed within the casing 4, the tube 10 is placed externally above the plane S—S' of the end-wall 13 by virtue of the fact that this end-wall is provided opposite to the tube with an oblong opening 43 through which said tube is permitted to pass as indicated in FIG. 2.

The sides of said opening 43 are formed by two projecting resilient lips 44, 45 which converge externally towards each other and extend parallel to two opposite and parallel edges 46, 47 of the opening 43.

In the state of rest, the ends 48, 49 of said lips 44, 45 are spaced at an interval which is smaller than the thickness of the arms of the tube 10. In consequence, when the tube is located in its final position after having separated the lips 44, 45, an effective clamping force is exerted on the end portions 32*a*, 33*a* of the arms of the tube 10 in order to ensure that this latter is supported mechanically. Since the luminous column which is established within the tube 10 is essentially placed above the ends of the lips 44, 45, excellent luminous efficiency is achieved by these supporting means.

Mechanical protection of the tube 10 is ensured by the presence of the transparent cover 5 which is fitted on the end-wall 13 of the casing 4 and which is rigidly fixed thereto by means of through-screws such as the screw 51, the length of which is sufficient to be anchored in corresponding threaded bores of the base 3.

In the embodiment illustrated, the device in accordance with the invention has a cylindrical shape of revolution but could also be prismatic and the plane of the printed circuit card 17 is parallel to the axis X—X' as well as to the plane which passes through the tube 10.

In order to mount the assembly constituted by the tube 10 and the card 17 which are connected together by means of soldered joints formed between the terminals 36, 37 and the tracks 38, 39, it is only necessary to engage said assembly within the casing 4 by sliding the edges of the card within the grooves 21, 22 formed in the side walls 14, 15 of the casing and by sliding the tube 10 between the resilient lips 44, 45.

It is then only necessary to close the casing 4 by means of the end-plate 24 and to attach the cover 5 and the base 3 by means of the screws 51.

As will be readily apparent, the invention is not limited to the example of construction described in the foregoing and any number of modifications may be made in this latter without thereby departing either from the scope or the spirit of the invention.

When a luminous signalling device in accordance with the invention has an envelope diameter or transverse dimensions which are larger than those considered in the foregoing, the printed circuit card can be disposed in a transverse plane with respect to the axis. In the case just mentioned, it is also possible as well as easier to employ a plurality of luminescent tubes each associated with one and the same card which is secured to the body, each tube being passed through one pair of resilient lips which form part of the same body end-wall. If so required, the transparent cover may accordingly be provided with sectors having different colors.

Moreover, that face of the end-wall 13 which is adjacent to the luminous tube 10 could be provided with a reflecting coating which improves the performances of the luminous device in accordance with the invention.

What is claimed is:

1. An optical signalling device having a partially transparent envelope (2), a substantially U-shaped luminous tube (10) containing a gaseous atmosphere being placed within said envelope and supplied by a capacitor (C) which is charged and discharged by means of electric circuits placed on a printed circuit card wherein, within an insulating casing (4) having an end-wall (13) and side walls (14, 15), there is placed and maintained said printed circuit card (17) which carries conductive tracks (38, 39) soldered directly to the supply terminals (36, 37) of the gas tube (10), said gas tube being placed in a plane substantially parallel to a longitudinal axis of the casing (4) and having two portions (32*a*, 33*a*) adjacent to the ends of its arms (32, 33) which are securely clamped between two resilient lips (44, 45) forming part of the end-wall (13) through which they pass, whilst the bent region (35) of said tube extends externally of said end-wall and is protected by a transparent cover (5) of the envelope (2).

2. A signalling device according to claim 1, wherein the printed circuit card (17) is maintained in a plane parallel to said longitudinal axis of the casing (4) along which said card is guided longitudinally, and the gas tube (10) extends in a plane parallel to said card.

3. A signalling device according to claim 2, wherein two said supply terminals (36, 37) of the tube (10) are soldered directly on one end (23) of the card (17) which is adjacent to the end-wall (13) of the body (4).

4. A signalling device according to claim 1, wherein one end (17*a*) of the card (17) remote from the end-wall (13) has removable connection means (27, 28) which are guided within grooves (21,22) of the walls (14, 15) and which are capable of cooperating with insulated contact-pins (9) located in a base (3) associated with the casing (4).

5. A signalling device according to claim 1, wherein that face of the end-wall (13) which is adjacent to the luminous tube (10) is reflecting.

* * * * *